United States Patent [19]

Tezucar et al.

[11] Patent Number: 4,533,913

[45] Date of Patent: Aug. 6, 1985

[54] GAS-FILLED DOT MATRIX DISPLAY PANEL AND OPERATING SYSTEM

[75] Inventors: Okan K. Tezucar, Scotch Plains, N.J.; David A. Parisi, Staten Island, N.Y.

[73] Assignee: Burroughs Corporation, Detroit, Mich.

[21] Appl. No.: 482,590

[22] Filed: Apr. 6, 1983

[51] Int. Cl.[3] ..... G09G 3/28

[52] U.S. Cl. ..... 340/805; 340/771; 340/775; 315/169.4

[58] Field of Search ..... 340/769, 771, 773, 775, 340/776, 768, 811, 805; 315/169.4

[56] References Cited

U.S. PATENT DOCUMENTS

| | | | |
|---|---|---|---|
| Re. 31,231 | 5/1983 | Ogle et al. | 340/775 |
| 3,683,364 | 8/1972 | Holz et al. | 340/775 |
| 3,868,543 | 2/1975 | Holz et al. | 340/775 |
| 4,114,069 | 9/1978 | Yamaguchi et al. | 340/771 |
| 4,329,616 | 5/1982 | Holz et al. | 340/771 |
| 4,342,993 | 8/1982 | Holz | 315/169.4 |
| 4,414,490 | 11/1983 | Harvey | 315/169.4 |

*Primary Examiner*—Gerald L. Brigance

*Attorney, Agent, or Firm*—Kevin R. Peterson; Edmund M. Chung; Robert A. Green

[57] ABSTRACT

A display panel comprising a matrix of D.C. scan cells arrayed in rows and columns and a matrix of A.C. display cells arrayed in rows and columns, each scan cell being in operative relation with two display cells so that for every column of scan cells there are two sets of display cells. The panel also includes two sets of sustainer electrodes associated with the two sets of display cells and properly operated by complementary oppositely phased sustaining signals in conjunction with the scan cells to select and turn on desired display cells, column by column. Also disclosed is a circuit for generating the two oppositely phased sustainer signals for the two sets of sustainer electrodes.

10 Claims, 7 Drawing Figures

GAS-FILLED DOT MATRIX DISPLAY PANEL AND OPERATING SYSTEM

BACKGROUND OF THE INVENTION

A gas-filled dot matrix display panel having memory is disclosed in copending application Ser. No. 051,313, now U.S. Pat. No. 4,386,348, filed June 22, 1979, of George E. Holz and James A. Ogle. This panel includes a matrix of D.C. scanning/address cells arrayed in rows and columns and a matrix of quasi A.C. display cells which are in operative relation with the scanning/address cells, and there is one scan cell for each display cell. The panel includes a relatively complex array of electrodes including a glow sustaining electrode which controls the operation of the display cells.

Another form of this memory panel is described and claimed in copending application Ser. No. 451,843, filed Dec. 21, 1982 by George E. Holz and James A. Ogle. This panel is known as a "shared scan" panel, which means that each scan/address cell operates with two display cells. In this panel, the sustainer electrodes which control the operation of each pair of display cells are operated in pairs, and special sustainer signals are applied to the pairs of sustainer electrodes to achieve the desired display cell selection.

An electronic system for generating sustainer signals for a memory panel of the type under consideration is described and claimed in U.S. Pat. No. 4,315,259 of Joseph E. McKee and James Y. Lee; however, this system is not directly applicable to a "shared scan" memory panel. The present invention provides a system for generating the required sustainer signals for a "shared scan" panel.

DESCRIPTION OF THE INVENTION

Figure 1:
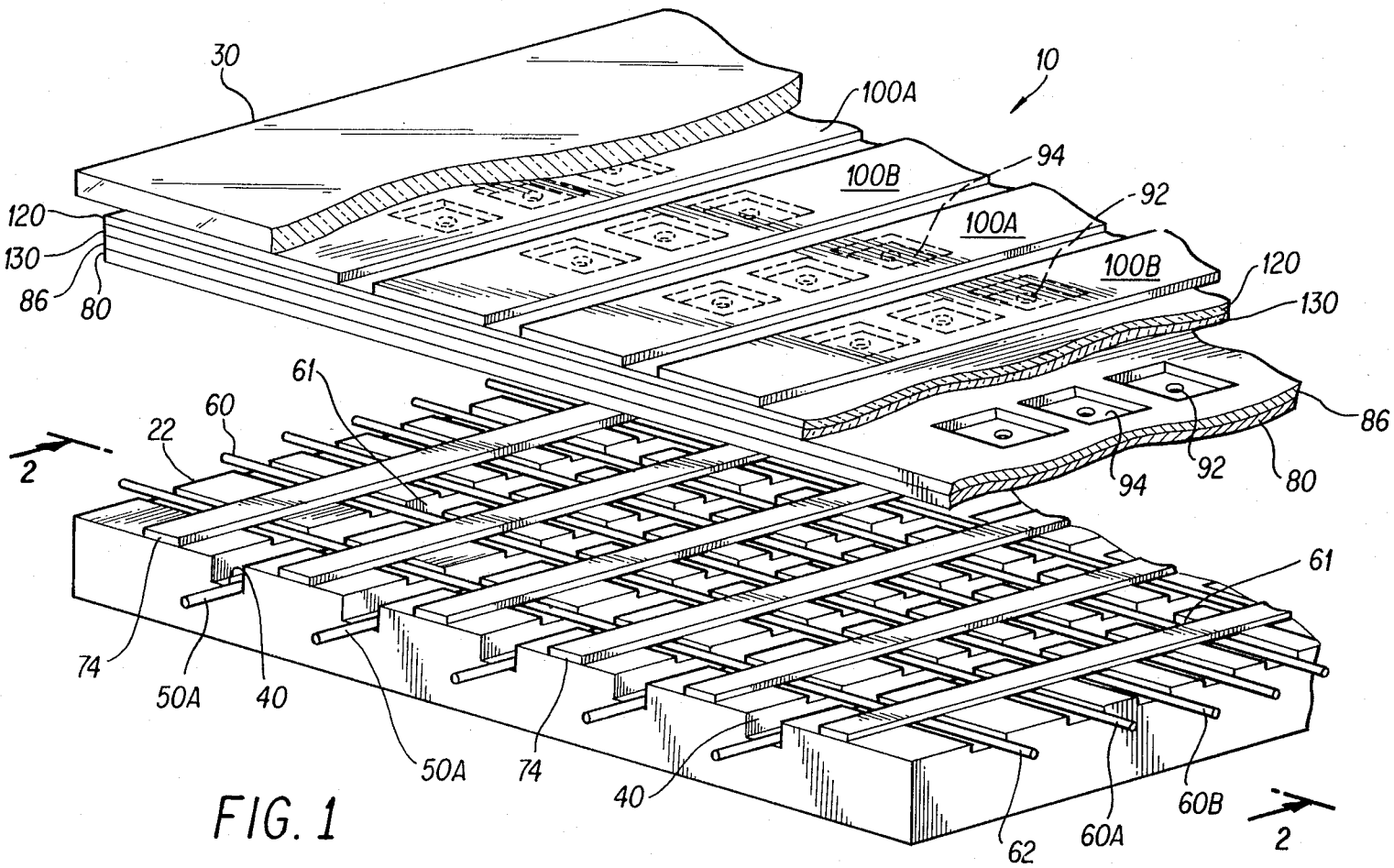
FIG. 1 is a perspective, exploded view, partly in section, of a display panel embodying the invention.

The invention relates to a display panel 10 of the type shown in herein-incorporated copending application of George E. Holz and James A. Ogle, Ser. No. 451,843, filed Dec. 21, 1982. This application describes a dot matrix memory display panel.

The display panel 10 includes a gas-filled envelope made up of a glass base plate 20 and a glass face plate 30. These two plates are put together and aligned and are hermetically sealed together along their aligned peripheries to form the desired envelope which surrounds the operating inner portion of the panel and the various gas cells provided therein. The base plate has a top surface 22, in which a plurality of relatively deep parallel longitudinal slots 40 are formed and in each of which a scan-/address anode electrode 50 is seated and secured.

Figure 2:
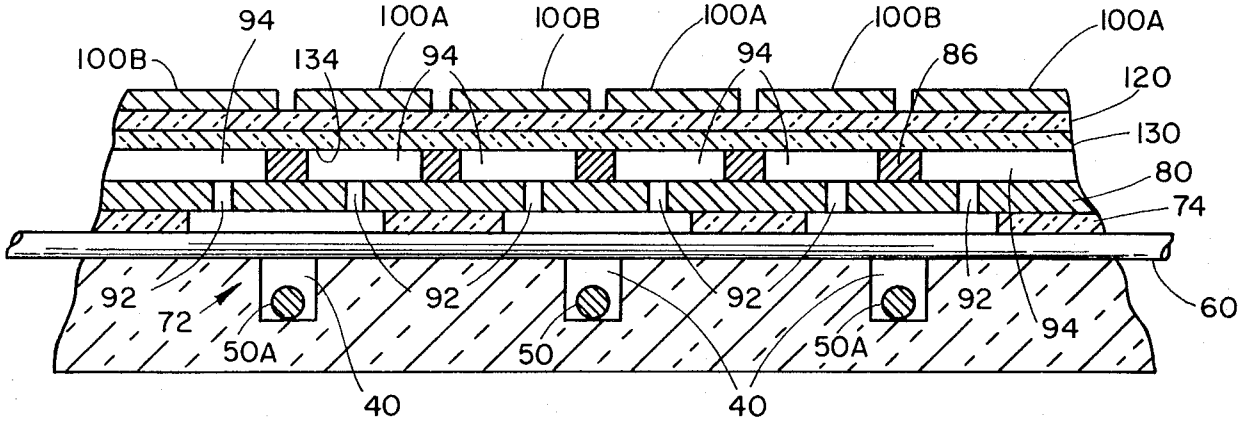
FIG. 2 is a sectional view of a portion of the panel of FIG. 1 along the lines 2—2 in FIG. 1 with the panel assembled.

A plurality of cathode electrodes 60 are seated in shallow, parallel slots 70 in the top surface 22 of the base plate. The cathodes 60 are called scan cathodes, and they are disposed transverse to the slots 40 and to scan anodes 50, and each crossing of a scan cathode 60 and a scan anode 50 defines a D.C. scan/address cell 72 (FIG. 2). It can be seen that the anodes 50 and cathodes 60 form a matrix of scanning cells which are arrayed in rows and columns.

The scan cathodes 60A, B, C, etc., form a series of cathodes which are energized sequentially in a scanning cycle, with cathode 60A being the first cathode energized in the scanning cycle.

A reset cathode electrode 62 is disposed adjacent to the first scan cathode 60A, and, where the reset cathode crosses the scan anodes, a column of reset cells is formed. These reset cells are turned on or energized at the beginning of each scanning cycle, and they generate excited particles which expedite the turn-on of the first column of scan/address cells associated with cathode 60A.

A strip 74 of insulating material is provided on the top surface of the base plate 20 extending along each land between each pair of anode slots 40.

Adjacent to the base plate or scan/address assembly described above is a quasi A.C. display assembly which includes a metal plate electrode 80, known as the priming plate, which has a matrix of rows and columns of relatively small apertures or holes 92, known as priming holes, with each column of priming holes aligned with and overlying one of the cathodes 60. In addition, along each row of holes, the holes are more or less grouped with each group overlying and in operative relation with the portion 61 of the underlying cathode associated with a scan cell. In FIG. 1, the priming holes are grouped in pairs, but other groupings may also be used. The plate 80 is positioned close to cathodes 60 and may be seated on insulating strips 74.

Seated on plate 80 is another apertured plate 86, the glow isolator plate, having rows and columns of apertures 94 which are larger than apertures 92. The apertures 94 comprise the display cells of panel 10, and each is disposed above one of the holes 92. The plate 86 may be of insulating material, or it may be of metal. Plates 80 and 86 may be made as one piece, if desired.

The quasi A.C. assembly also includes, on the inner surface of the face plate 30, a plurality of parallel strips 100A and 100B of transparent conductive material. These strips comprise A.C. electrodes known as glow sustaining electrodes. The strips 100 run parallel to the anodes 50, and each is so wide that it overlies one row of display cells 84 and one anode 50.

An insulating transparent coating 120 of glass covers electrodes 100, to make them A.C. electrodes, and, if desired, a dielectric layer 130 of magnesium oxide, thorium oxide, or the like is provided on glass layer 120.

The panel 10 includes a suitable keep-alive mechanism, one form of which is shown in U.S. Pat. No. 4,329,616 of Holz and Ogle. A keep-alive is not shown, to simplify the drawing, but is illustrated schematically in FIG. 1.

The gas filling in panel 10 is preferably a Penning gas mixture of, for example, neon and a small percentage of xenon, at a pressure of about 400 Torr.

Means for connecting the various electrodes of panel 10 to external circuitry are not shown, in order to simplify the drawings.

The panel 10 operates generally in accordance with the principles set forth in detail in copending application Ser. No. 051,313. A brief description of the operation of panel 10 is as follows, with the panel and an operating system being shown schematically in FIG. 3. The operating system includes a power source 170 for the keep-alive mechanism 171 and a source 172 of negative reset pulses coupled to reset cathode 62. The cathodes 60 are connected in groups or phases with, for example, every third cathode being connected together in the same group, to form three groups or phases, each group being connected to its own cathode driver 180. Other cathode groupings may also be employed, as is well known.

Each of the scan anodes 50 is connected through a suitable resistive path (not shown) to a D.C. power source 185 and to a source 186 of addressing or write signals to perform write and erase operations. The source of addressing signals 186 may include, or be coupled to, a computer and whatever decoding circuits and the like are required. A source 187 of D.C. bias potential is coupled to plate 80, and a source 188 of glow-sustaining pulses is connected to the transparent conductive strip electrodes 100A, and a similar source 189 of glow-sustaining pulses is connected to the strip electrodes 100B.

All of the circuit elements required to drive panel 10 are not shown, in order to keep the drawing as clear and simple as possible. Circuit elements such as diodes, resistors, ground connections, and the like can be readily provided by those skilled in the art and by reference to the application cited above and to the patents and articles referred to therein.

Figure 5:
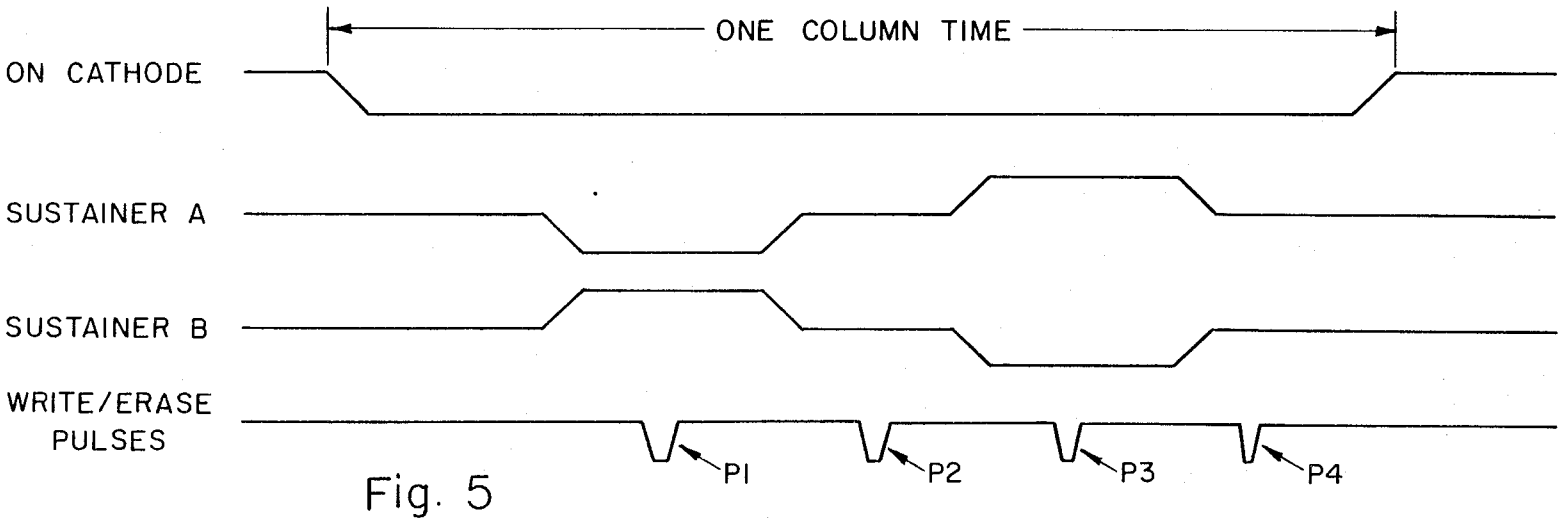
FIG. 5 shows waveforms used in operating the panel of FIG. 1.
Figure 3:
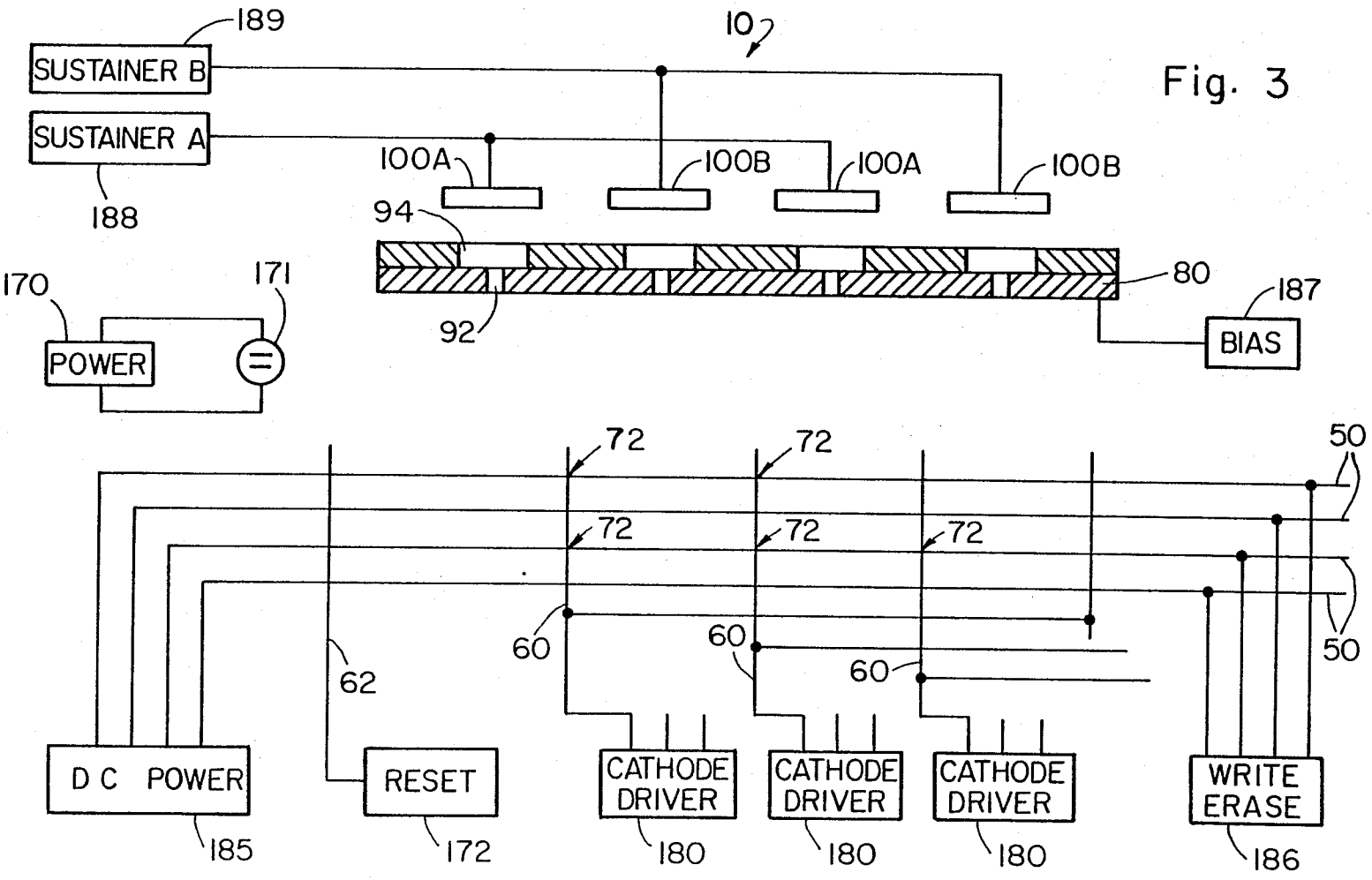
FIG. 3 is a schematic showing of the panel of FIG. 1 and an electronic system for operating it.

Briefly, in operation of the panel and system illustrated in FIG. 3, the scanning cells 72 are energized column-by-column at a selected scan frequency, and simultaneously sustainer pulses are applied from sources 188 and 189 to electrodes 100A and 100B, in synchronism with the column scan, so that, as each column of scan cells is being scanned, negative and positive sustainer pulses are applied to electrodes 100A and similar pulses are applied to electrodes 100B. The two sets of sustainer pulses are suitably out of phase with each other in accordance with the principles of the invention and generally as illustrated in FIG. 5.

Under these conditions, if the data or address signals from source 186 direct that a particular display cell be turned on, when the column containing the scan cell beneath that display cell is being scanned, that scan cell is momentarily turned off, in synchronism with, and during, the application of a positive sustainer pulse to electrodes 100A or 100B and it is then turned back on, so that the scanning operation can proceed normally. During the period when this scan cell is turned off, and its discharge is in the process of decaying, a positive column is drawn to electrode 80 and electron current flows from its electrode portion 61 to electrode 80, and electrons are drawn through the aperture 92 in electrode 80 into the selected display cell 94 by the positive sustainer pulse. This combination of effects, with some current multiplication probably occurring in the display cell, produces a negative wall charge on wall 134 of the selected display cell, and the combination of the voltage produced by this wall charge and the voltage of the next negative sustainer pulse produces a glow discharge in the selected display cell. This discharge, in turn, produces a positive wall charge on wall 134, which combines with the next positive sustainer pulse to produce a glow discharge, and, in similar manner, successive sustainer pulses produce successive discharges and consequent visible glow in the selected cell.

After all cell columns have been scanned and the desired display cells have been turned on, the sustainer pulses keep these cells lit and the written message displayed. If desired, at this time, the same sustainer signal can be applied to all of the sustainer electrodes 100A and 100B.

The erasing operation is similar. In erasing, as in writing, the selected display cell is operated upon while its underlying scan cell is being scanned, but the erase signal is applied in synchronism with, but following the negative sustainer pulse. For the erase operation, the associated scan cell is again turned off momentarily, and then back on, to avoid interfering with the normal column-by-column scan of the scan cells. While it is off, the decaying discharge around electrode portion 61 again produces electron flow to electrode 80, and through the aperture in that electrode into the display cell. This serves to remove, or neutralize, the positive charge then on wall 134 of the display cell (which charge was produced by the most recent negative sustainer pulse) so that the next sustainer pulse will fail to produce a glow discharge, and glow in the selected cell will cease.

Figure 4:
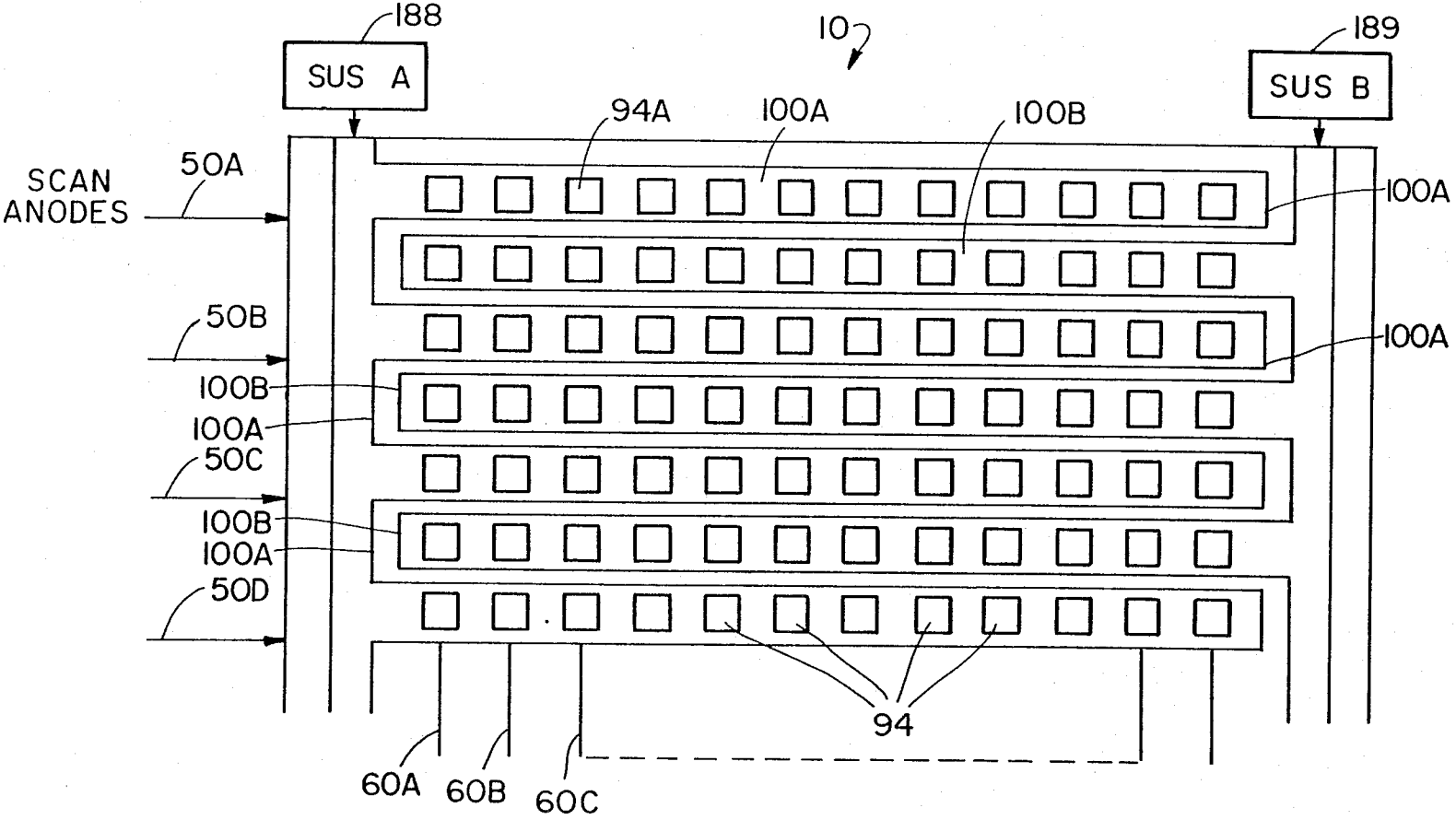
FIG. 4 is a schematic plan view of a portion of the panel of FIG. 1 and associated electronic circuit.

The operation of the invention is described in somewhat greater detail with respect to FIGS. 4 and 5. FIG. 4 is a plan view of portions of the display panel 10 shown in FIG. 1, and FIG. 5 shows some of the waveforms applied to panel 10.

FIG. 5 shows the two sustainer pulses SUS A and SUS B from sources 188 and 189 as they appear in one column time and four possible write or erase conditions which may be achieved with address or data pulses P1, P2, P3, and P4 from source 186. These four possibilities are set forth in the following table.

TABLE I

| Pulse: | P1 | P2 | P3 | P4 |
|---|---|---|---|---|
| SUS A: | — | erase | write | — |
| SUS B: | write | — | — | erase |

Thus, since pulse P1 is applied at the time that sustainer B is positive, then the display cell associated with sustainer B is turned on. Pulse P2 is applied after sustainer A has executed the negative portion of its cycle so that the display cell associated with sustainer A is erased. Pulse P3, like P1, is applied when sustainer A is at the positive portion of its cycle and its associated display cell is turned on; and pulse P4, like Pulse P2, occurs after the negative portion of the cycle of sustainer B so that the display cell associated with sustainer B is erased.

As a more specific example, referring to FIGS. 4 and 5, if it is desired to write or turn on display cell 94A, which appears at the crossing of scan anode 50A and cathode 60B, when the first column of scan cells is turned on and when electrode 100A has the positive portion of the sustainer pulse on it, the negative write pulse P is applied to scan/address anode 50A. This causes the positive column to be drawn from cathode 60B into display cell 94A, and the action described occurs and causes glow in display cell 94A. This glow is sustained by sustainer signal SUS A. The same operation is performed through the panel to turn on selected cells in each of the columns of display cells, and then the entire entered message is sustained by the same sustainer signal applied to all of the sustainer electrodes 100.

Figure 6:
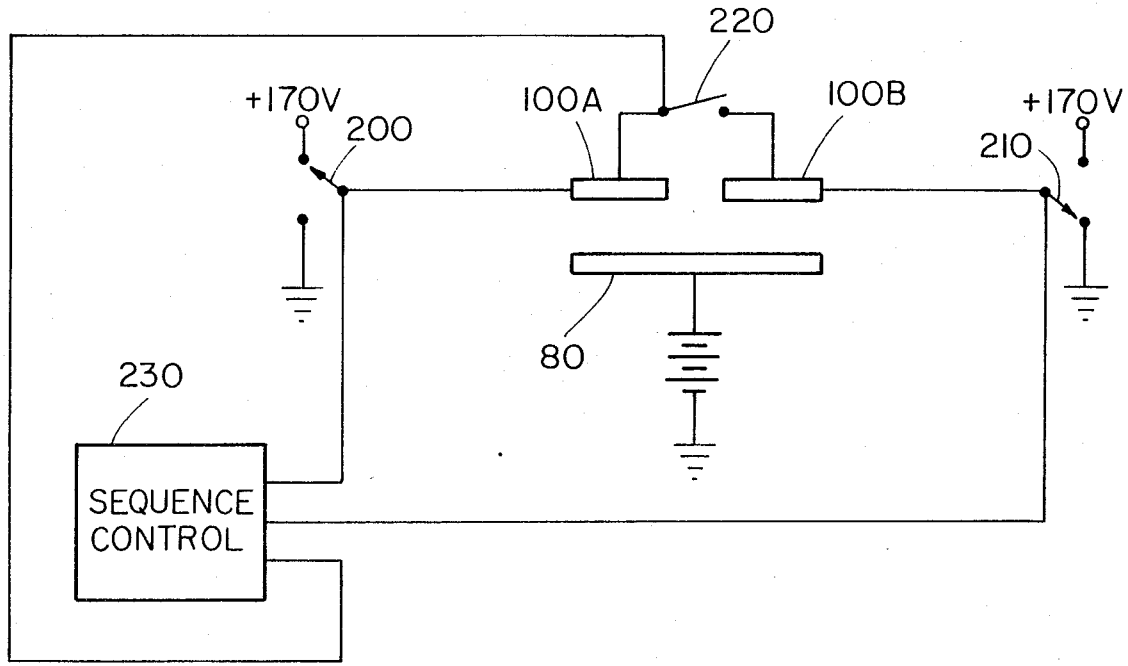
FIG. 6 is a schematic showing of a portion of the panel of FIG. 1 and an electronic system embodying the invention.
Figure 7:
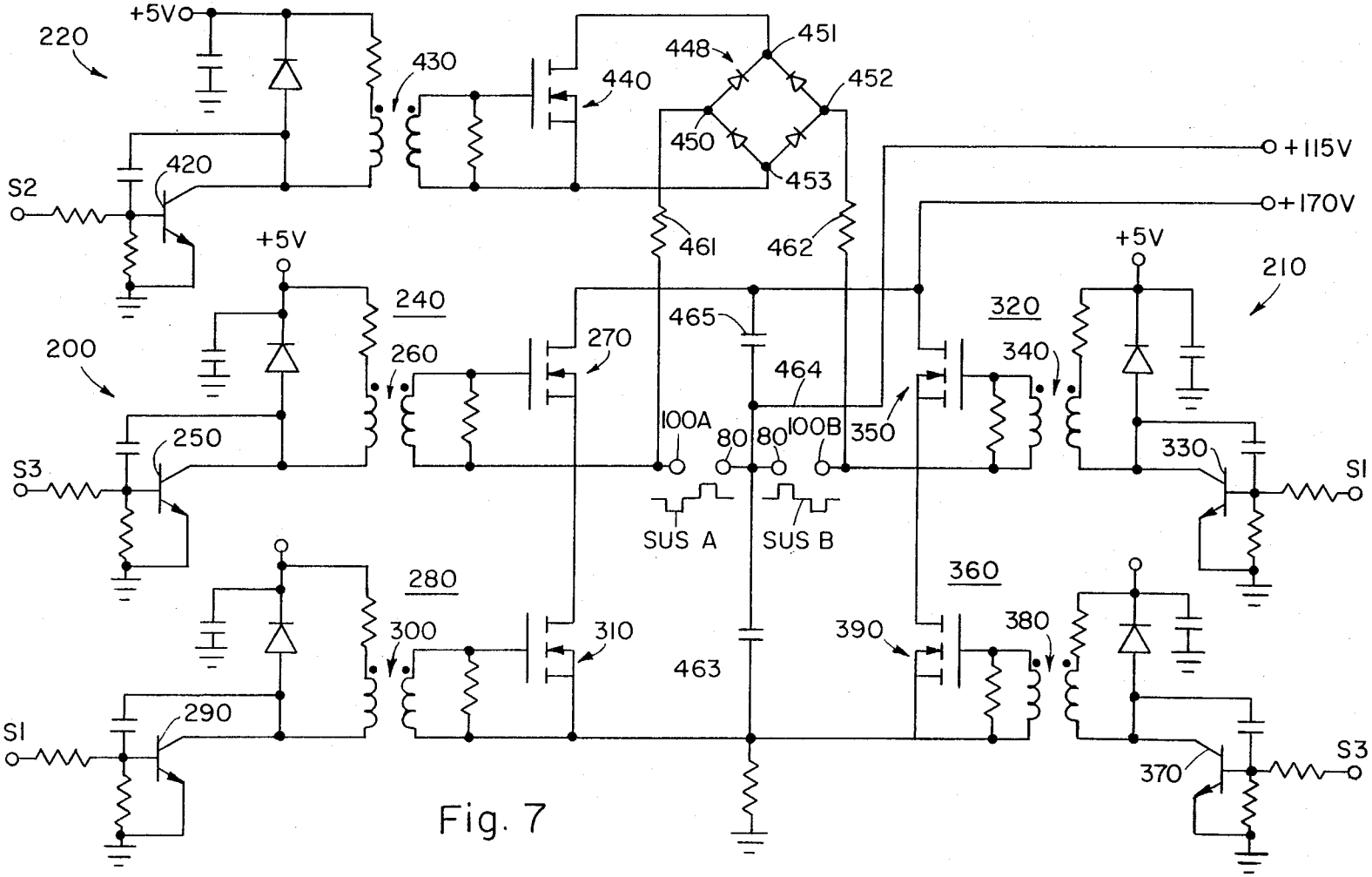
FIG. 7 is a detailed schematic of the system of FIG. 6.

It is noted, as shown in FIG. 5, that the two sustainer signals, SUS A and SUS B, applied to the two sets of sustainer electrodes, 100A and 100B, are exactly opposite in phase, and a system for generating these waveforms, according to the invention, is shown in FIGS. 6 and 7.

The principles of operation of the invention are described with respect to FIG. 6, which is a schematic representation of priming plate 80 and a sustainer electrode 100A and a sustainer electrode 100B. The priming plate is shown connected to a positive power source of about 115 volts, and sustainer electrode 100A is connected to a switch 200 which is operable to connect this electrode, either to ground or to a positive potential of about 170 volts. Sustainer electrode 100B is also connected to a switch 210 which is operable to connect this electrode either to ground or to the same positive potential, 170 volts. The switches 200 and 210 are arrayed to operate simultaneously but in opposite directions so that, when electrode 100A is connected to positive potential, electrode 100B is connected to ground, and vice versa. A third switch 220 is connected between the two sustainer electrodes and is operable to connect them directly together.

A sequence control circuit 230 is provided and coupled to the three switches to carry out the following sequence of operations: (1) operate switches 200 and 210 to apply the potentials shown to the sustainer electrodes 100A and 100B, (2) operate switch 220 to connect the two sustainer electrodes together electrically and at approximately 85 volts, (3) operate switches 200 and 210 to reverse the potentials on the sustainer electrodes 100A and 100B, (4) operate switch 220 as in step (2) above, (5) continue the cycle of steps (1) through (4).

As the foregoing sequence of steps is carried out, with step (1), the positive and negative pulses of sustainer signals SUS A and SUS B are applied to the sustainer electrodes; when step (2) is carried out, the sustainer electrodes are set at reference level; when step (3) is carried out, the potentials on the sustainer electrodes are reversed to provide the indicated reverse pulses; and, when step (4) is carried out, the sustainer electrodes are again returned to reference potential.

The system of FIG. 6 is illustrated in greater detail in FIG. 7 wherein switch 200 is made up of a first circuit 240 including an NPN transistor 250 coupled through a transformer 260 to a field effect transistor (FET) 270 and a second circuit 280 including an NPN transistor 290 coupled through a transformer 300 to a field effect transistor 310. The switch 210 is made up of a first circuit 320 including an NPN transistor 330 coupled through a transformer 340 to a field effect transistor 350 and a second circuit including an NPN transistor 370 coupled through a transformer 380 to a field effect transistor 390. The switch 220 is made up of a circuit including an NPN transistor 420 coupled through a transformer 430 to a field effect transistor 440.

The system of FIG. 7 also includes a four-sided diode bridge 448 connected as shown and having four terminals 450, 451, 452, 453. The FET 440 has its drain and source connected between terminals 451 and 453 of the diode bridge. Terminal 450 is coupled through a resistive path 461 to sustainer electrodes 100A and to the commonly-connected source of FET 270 and drain of FET 310. Terminal 452 of the bridge 448 is coupled through a resistive path 462 to sustainer electrodes 100B and to commonly-connected source of FET 350 and drain of FET 390. The priming plate 80 is coupled both through a capacitor 463 to ground and by lead 464 to a positive power source, for example of 115 volts. A positive power source of about 170 volts is coupled to the drains of FETs 270 and 350 and through capacitor 465 to the priming plate 80.

In operation of the system of FIG. 7, at the beginning of an operating sequence, the sequence control circuit applies turn-on pulses to the input terminals S1 coupled to transistor 290 of circuit 280 and transistor 330 of circuit 320. When transistor 290 turns on, current flows through transformer 300, and FET 310 is turned on and the negative portion of sustainer pulse is generated and applied to sustainer electrodes 100A. Simultaneously, in circuit 320, when FET 350 turns on, the power supply of 170 volts generates current flow through the FET and generates the positive portion of the sustainer signal applied to sustainer electrodes 100B. After a predetermined time, an input signal is applied to S2 or circuit 220, and this causes FET 440 to turn on and to operate through the diode bridge to bring the sustainer electrodes all to the same reference potential level or 85 volts. Then, after a predetermined time, an input signal applied to switches S3 of circuits 240 and 360 cause circuit 360 to generate the negative-going portion of the sustainer waveform SUS B, and the turn-on of FET 270 causes the generation of the positive-going portion of the sustainer signal SUS A. Then, after a time, circuit 220 is turned on again to bring the sustainer signals to the reference voltage level. The sequence control causes this operation to be performed continuously.

What is claimed is:

1. A display panel and system comprising a matrix of first gas-filled cells arrayed in rows and columns, an anode electrode and a cathode electrode associated with said first cells, each of said cathode electrodes including a series of operating cathode portions, each portion being associated with one of said first cells, circuit means coupled to said anode and cathode electrodes for turning on said first cells column by column in a scanning cycle, the turn-on of said cells generating cathode glow, said circuit means also being operable to turn off each anode selectively to turn off the first cells associated therewith, a matrix of display cells arrayed in rows and columns, in each column of first cells and display cells there are two display cells associated with each first cell and each cathode portion, a sustainer electrode disposed along each row of display cells, a sustainer signal coupled to each sustainer electrode with the sustainer signals applied to adjacent sustainer electrodes including positive and negative pulses in series, with one sustainer signal being 180° out of phase with the other, and an electronic system for generating said sustainer signals, said system comprising first circuit means for simultaneously generating positive and negative pulses at the respective sustainer electrodes, second means for returning said sustainer signals and electrodes to a reference level after the termination of said positive and negative pulses, third means for generating negative and positive pulses at the respective sustainer electrodes, and control means for operating said first, second and third means in repetitive sequences, with the second means being operated after the first means is operated and after the third means is operated to produce two simultaneous sustainer signals, one of which includes a positive pulse, a reference level, a negative pulse, and a reference level, and the other signal includes a negative pulse, a reference level, a positive pulse, and a reference level.

2. The apparatus defined in claim 1 wherein each of said circuit means includes a transistor coupled through a transformer to a field effect transistor.

3. The apparatus defined in claim 1 wherein said first circuit means includes two semiconductor switching circuits which are turned on simultaneously and one of which generates a negative pulse and the other of which generates a positive pulse, said second circuit means comprises a semiconductor switching circuit operating through a diode bridge to couple together the two sets of sustainer electrodes electrically, and said third circuit means includes two semiconductor switching circuits which are adapted to be turned on simultaneously and one of which generates a negative pulse and the other of which generates a positive pulse.

4. The display panel defined in claim 1 wherein each anode electrode is aligned with a column of cells and each cathode electrode is aligned with a row of cells.

5. The display panel defined in claim 1 wherein said circuit means turns on said first cells column by column.

6. The display panel defined in claim 1 wherein each sustainer electrode overlies and is in operative relation with one row of display cells.

7. The display panel defined in claim 1 wherein each sustainer electrode overlies and is in operative relation with two adjacent rows of display cells, each row of the two rows operated by one sustainer electrode being associated with a different one of said anode electrodes whereby display cell selection may be achieved.

8. The display panel defined in claim 1 wherein said first cells are D.C. cells wherein said anode and cathode electrodes are in contact with the gas therein, and said sustainer electrodes are insulated from the gas.

9. The display panel defined in claim 1 and including an apertured electrode disposed between said first cells and said sustainer electrodes.

10. The display panel defined in claim 1 and including an apertured electrode disposed between said first cells and said sustainer electrodes, said apertured electrode including apertures made up of a small-diameter portion and a larger-diameter portion, said large-diameter portions comprising said display cells.

* * * * *